United States Patent [19]

Kornatowski et al.

[11] 4,421,043

[45] Dec. 20, 1983

[54] CONVERTIBLE BED FOR A SEWING MACHINE

[75] Inventors: Boleslaw Kornatowski, Elizabeth; Kenneth D. Adams, Madison, both of N.J.

[73] Assignee: The Singer Company, Stamford, Conn.

[21] Appl. No.: 386,176

[22] Filed: Jun. 8, 1982

[51] Int. Cl.[3] ..... D05B 73/10

[52] U.S. Cl. ..... 112/260

[58] Field of Search ..... 112/258, 260

[56] References Cited

U.S. PATENT DOCUMENTS

| | | | |
|---|---|---|---|
| D. 254,850 | 4/1980 | Wittler . | |
| 992,526 | 5/1911 | Weis . | |
| 3,188,993 | 6/1965 | Szuba et al. . | |
| 3,557,732 | 1/1971 | Simon et al. . | |
| 3,863,582 | 2/1975 | Patricia et al. . | |
| 4,009,671 | 3/1977 | Wittler et al. . | |
| 4,040,369 | 8/1977 | Kaito . | |
| 4,343,252 | 8/1982 | Hanyu | 112/258 |

FOREIGN PATENT DOCUMENTS

| | | |
|---|---|---|
| 50-81343 | 12/1975 | Japan . |
| 51-150453 | 5/1976 | Japan . |
| 53-53078 | 10/1978 | Japan . |
| 53-55178 | 10/1978 | Japan . |
| 53-55181 | 10/1978 | Japan . |
| 54-104954 | 8/1979 | Japan . |
| 55-58167 | 4/1980 | Japan . |
| 55-57061 | 4/1980 | Japan . |

*Primary Examiner*—Werner H. Schroeder
*Assistant Examiner*—Andrew M. Falik
*Attorney, Agent, or Firm*—William V. Ebs; Edward L. Bell; Robert E. Smith

[57] ABSTRACT

A free arm of a convertible bed sewing machine is provided with a rear bed extending member which is pivoted on a cover that is fitted over a fixed machine supporting leg but can be readily removed therefrom with the bed extending member to provide space for an embroidery attachment.

6 Claims, 6 Drawing Figures

CONVERTIBLE BED FOR A SEWING MACHINE

DESCRIPTION

BACKGROUND OF THE INVENTION

1. Field of the Invention

The invention is directed to a convertible bed type sewing machine.

2. Description of the Prior Art

Conventional convertible bed sewing machines of the so called free-arm type include a tubular work supporting free arm and means for extending a working surface thereon. The work supporting surface on the free arm has been rendered extendible with an auxiliary bed member adapted to be detachably fitted to the tubular free arm or pivotally mounted on the machine for movement into or away from a bed extending position. The detachable auxiliary bed is somewhat inconvenient to use because of the need to completely remove it from the machine when free arm sewing is to be performed, and to reattach it for flat bed type sewing. A pivoted auxiliary bed extending member which remains on the machine and is merely moved from one position to another depending upon the type of sewing to be performed is convenient to use, but limits the adapability of the machine for special use such as for embroidery work where space needed for the mounting of an embroidery attachment is taken up by the pivoted member.

It is a prime object of the present invention to provide a free-arm type machine with a pivoted auxiliary bed extending member which can be readily removed from the machine to provide space for an embroidery attachment.

It is another object of the invention to provide a free-arm type machine which can be conveniently converted with front and rear pivoted auxiliary bed extending members for flat bed or free arm use, and wherein one of the bed extending members can be readily removed from the machine with a detachable cover to provide space for an embroidery attachment.

Other objects and advantages of the invention will become apparent during a reading of the specification taken in connection with the accompanying drawings.

SUMMARY OF THE INVENTION

A free-arm type sewing machine is provided with a rear supporting leg and with a cover having a friction fit with the leg. A rear bed extending member for the free arm of the machine is pivotally mounted on the cover for movement into and away from a position wherein a work supporting surface on said bed extending member is coplanar with a work supporting surface on the free arm. The bed extending member and cover are removable as a unit from the machine and in this way adequate space is provided rearwardly of the free arm for an attachment. A rod is affixed to the bottom front end portion of the machine and a front bed extending member is mounted thereon for pivotal movement into and away from a position wherein a work supporting surface on such front member is coplanar with the work supporting surface on the free arm.

DESCRIPTION OF THE PREFERRED EMBODIMENT

Figure 1:
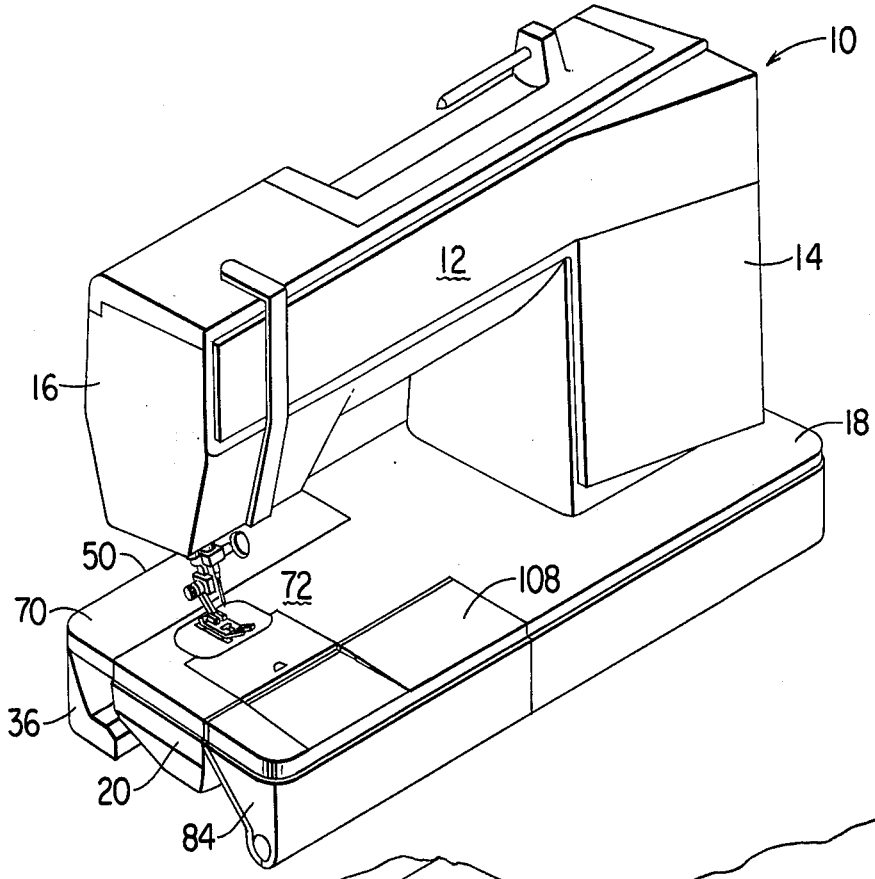
FIG. 1 is a perspective view showing a convertible bed sewing machine constructed according to the invention and readied for flat bed conventional sewing operations.

Referring to FIGS. 1 through 5 of the drawings, reference character 10 designates a sewing machine having a bracket arm 12 extending from an upright standard 14 to a depending head 16. A bed 18 which supports the standard includes a free arm 20 that extends under the bracket arm and head. As shown, the bed is formed with a rear channel-like member 22 at the bottom of the machine. Such channel-like member 22 is adapted to receive an insertable end portion 24 of a machine supporting leg 26 which is secured to the member 22 by screws 28 and 30 extending through holes 32 and 34 in the leg end portion 24 and into member 22.

A cover 36 which is preferably a molded plastic part, is formed to have a friction fit with member 22 and leg 26. The cover is provided with an outwardly extending end tab 38, an inwardly extending end tab 40, and an inwardly projecting dimple 42. The cover is fitted over member 22 and leg 26 with tab 38 in an end recess 44 in the bed 18, tab 40 in an end opening 46 in leg 26, and dimple 42 snapped into a top recess 48 in the leg 26.

A rear plate like bed extension member 50, preferably of a resilient plastic material, is affixed to cover supported elongate member 52 by screws 54 and 56 that extend through holes 58 and 60 in the member and through locator washers 62 and 64 in the holes. The elongate member 52 is mounted in the cover on pins 66 and 68 which define a pivotal axis for the bed extension member permitting such bed extension member to move between: (1) a flat bed position wherein a top working surface 70 thereon is coplanar with a top working surface 72 on the free arm (FIG. 1), and (2) a lowered out of the way position apart from the free arm (FIG. 2). A tab 74 provided on the edge of member 50 may be caused with slight flexure of member 50 either to enter a groove (not shown) in the free arm and maintain the member in the flat bed position, or be removed therefrom.

A rod 78 is affixed to the machine bed in a front bottom groove 79 with screws 80 and 82 to provide a pivotal axis for a front bed extension member 84. Member 84 includes outside and inside cover members 86 and 88 which are preferably plastic molded parts. The covers are secured together with screws 90, 91 and 92. Inside cover member 88 is formed with tabs 94, 96 and 98 having circularly curved bottom end portions 100, 102 and 104 which along with circularly curved bottom end portion 106 of outside cover member 86 embrace rod 78 and permit the cover to pivot on the rod 78 between an upright position (FIG. 1) wherein a working surface 108 is coplanar with free arm working surface 72, and a lowered flat position away from the free arm (FIG. 2). Flat resilient tabs 109 and 110 on member 88 engage flats 112 and 114 respectively on the rod 78 in the upright position of member 88 and so prevent member 84 from being accidentally displaced from its bed extending position. As shown, member 88 has been formed with bosses 116, to provide wells into which spools of thread may be placed for storage while member 84 is in its lowered flat position, and from which spools may be subsequently retrieved as required.

Figure 2:
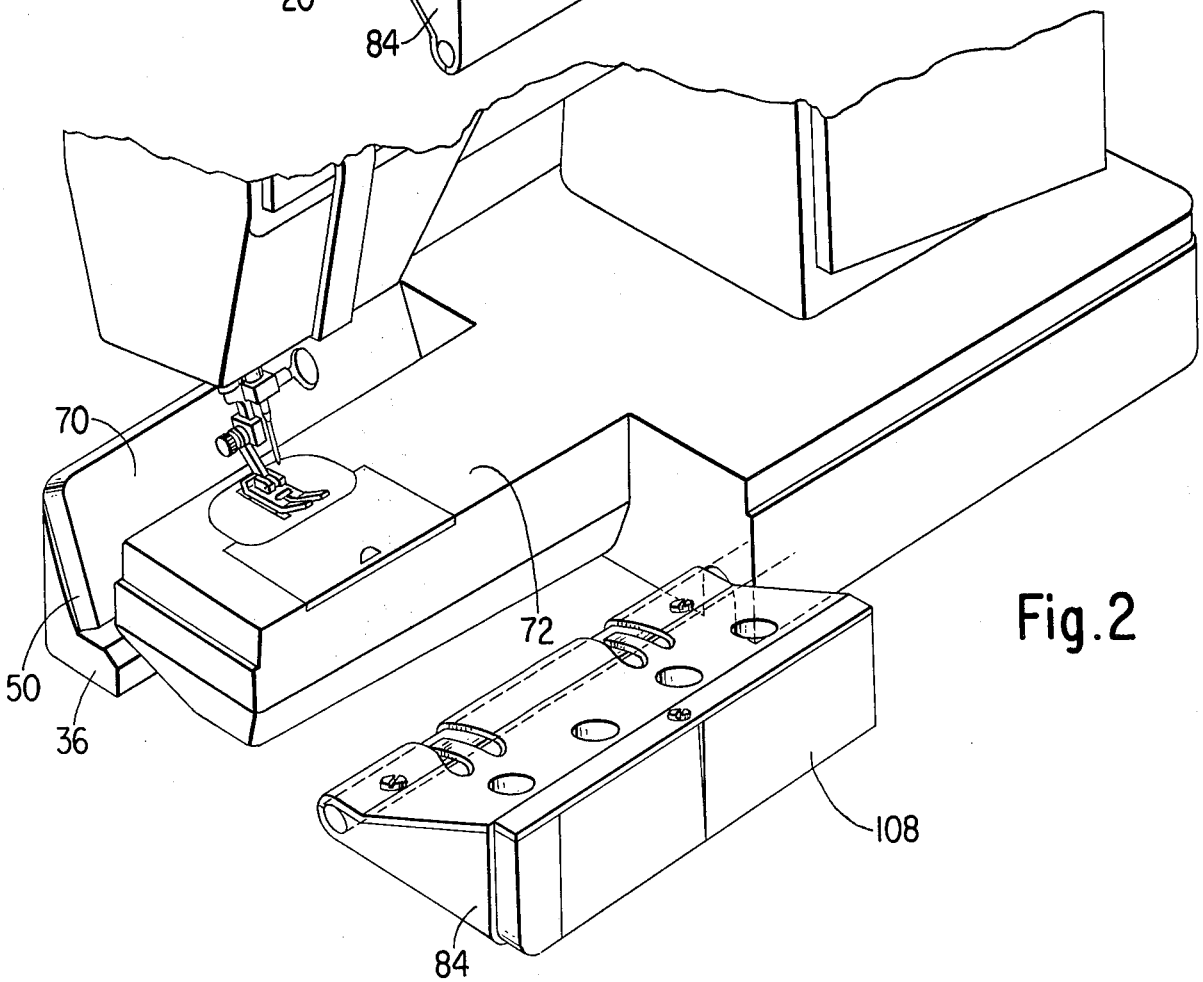
FIG. 2 is a view similar to FIG. 1 showing the machine readied for free-arm sewing.
Figure 3:
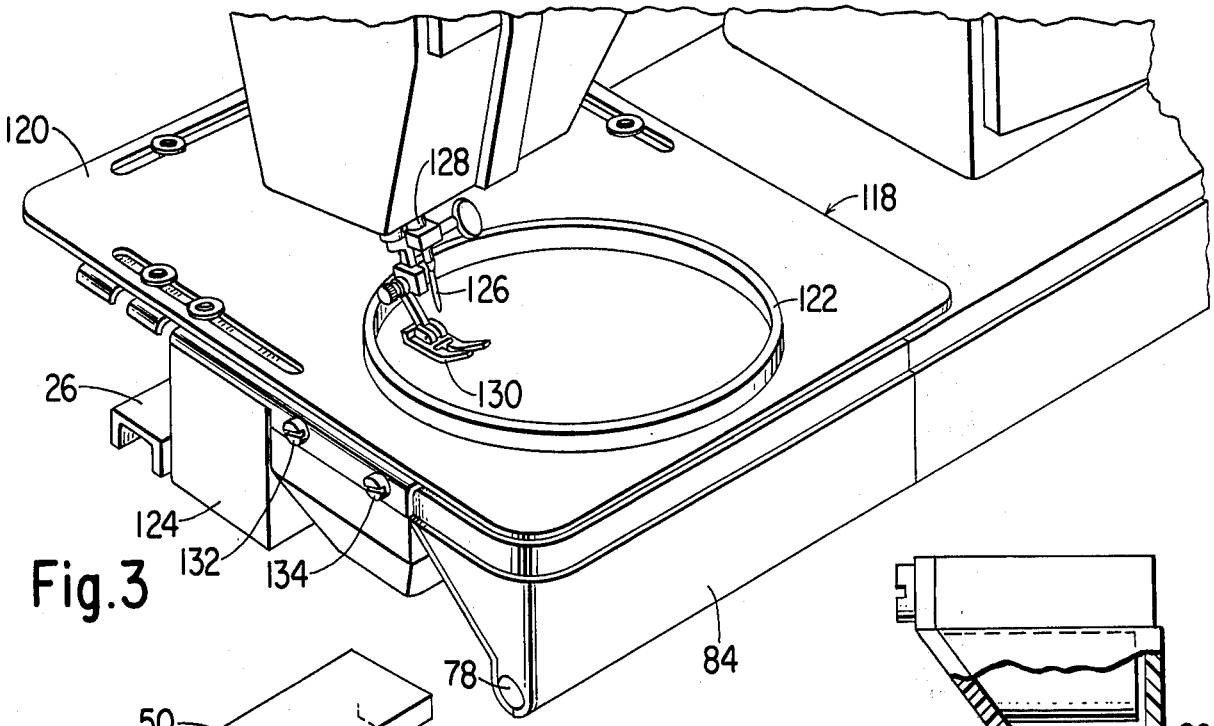
FIG. 3 is a fragmentary perspective view showing the machine of FIGS. 1 and 2 with an embroidery attachment on the machine.
Figure 4:
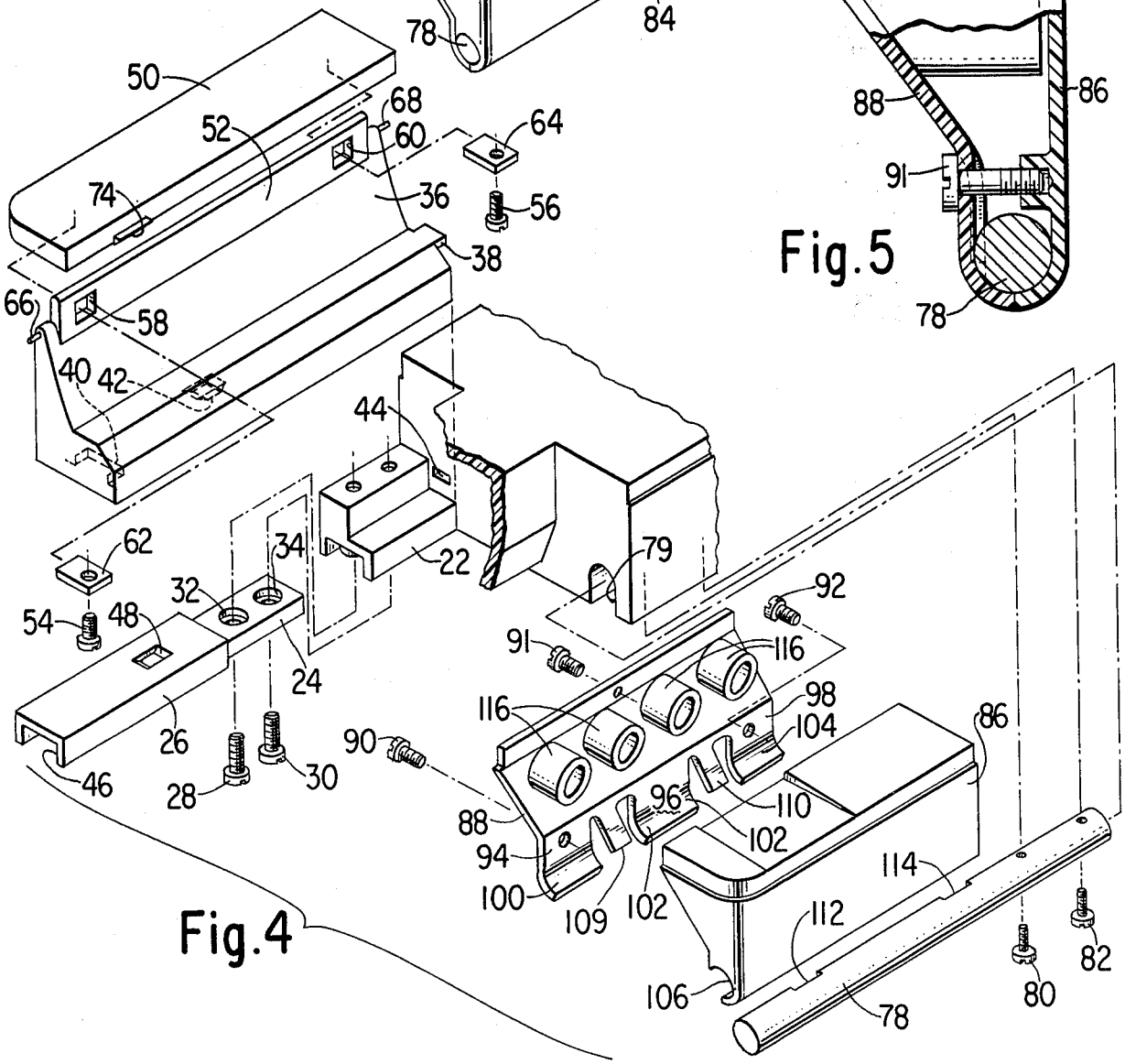
FIG. 4 is a disassembled perspective view showing the various parts of the machine of FIGS. 1 and 2.
Figure 5:
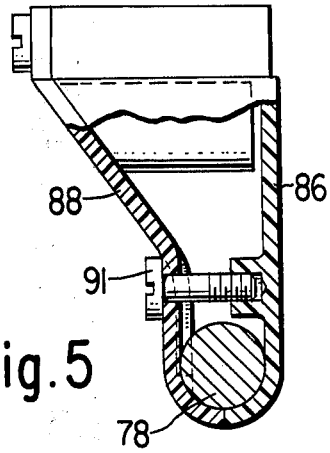
FIG. 5 is a cross-sectional view taken through a front bed extending member.

When it is desired to use the machine 10 for flat bed sewing, the rear bed extension member 50 and front bed extension member 84 are disposed about their pivotal axes with the work supporting surface on each, namely 70 and 108 respectively, coplanar with the free arm working surface 72 such that the free arm working surface is extended to a maximum extent (FIG. 1). When it is desired to use the machine for the free arm sewing of cuffs, collars and the like, the rear and front bed extension members are pivoted into their lowered positions (FIG. 2).

The machine may be readied to receive an embroidery attachement 118 by the removal from the machine of the cover 36 and bed extension member 50. The cover 36 and attached bed extension member 50 are removed as a unit from the machine by the separation of cover 36 from leg 26 after which the embroidery attachment may be disposed for use on the machine. As shown, embroidery attachment 118 includes a top plate 120 which carries a fabric clamping hoop 122. The top plate 120 which is to be understood as being movable in mutually perpendicular directions, operably connects with control mechanism located in a housing 124 under the plate. With the cover 36 and bed extension member 50 removed from the machine, there is sufficient space for housing 124 to be located closely adjacent the rear side surface by the free arm 20 in a position directly opposite sewing needle 126 which is affixed in a reciprocal needle bar 128 and with which embroidery work may be performed on fabric held on hoop 122. The embroidery attachment is slid into its position of use (FIG. 3) from the left end of the machine while disposed to permit the plate to move under a lifted needle 126 and presser foot 130. When suitably positioned, the attachment is secured to the free arm with suitable fastening means such as the screws 132 and 134.

Figure 6:
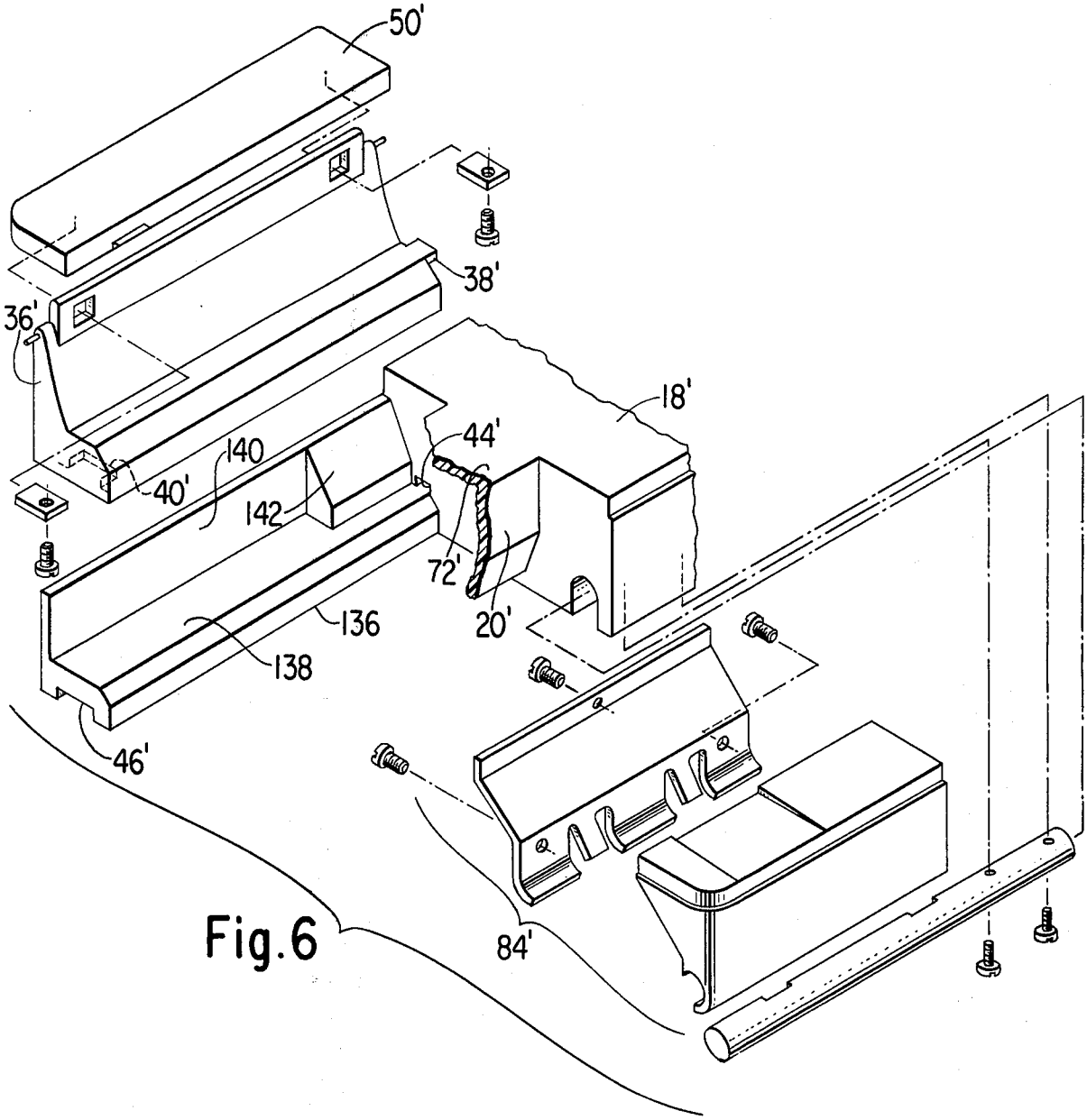
FIG. 6 is a disassembled perspective view showing the parts of a modified form of machine according to the invention.

A modified form of convertible bed machine according to the invention may be seen in FIG. 6 wherein parts similar to those in FIGS. 1 through 5 are designated with like reference characters having a prime mark (') added thereto. In general, the machine of FIG. 6 is similar to the machine already described. However, in the modified machine of FIG. 5 the bed 18' is formed with an integral rear leg 136 which includes a bottom portion 138, an upstanding back wall 140 and a back wall support 142. Bottom portion 138 and back wall 140 are substantially of the same length as cover 36'. Support 142 extends for only a portion of the length of bottom portion 138 so as to leave room for an embroidery attachment between the wall 140 and free arm 20'. Cover 36' fits snugly over the leg in contact with portion 138, wall 140 and support 142, and with tabs 38' and 40' extending into recess 44' and opening 46' in the bed and leg respectively. The cover 36' is readily removed from leg 136 with pivotally associated rear leg extension member 50' to provide space for an embroidery attachment which may be fitted and secured to the machine 10' as described hereinbefore.

In the machine of FIG. 6, rear bed extension member 50' and a front bed extension member 84' correspond to the bed extension members of FIGS. 1, 2, 3 and 4, and pivot between a position extending the top working surface 72' of the free arm and a position apart from the free arm. Front bed extension member 84' is shown without storage wells for spools of thread, but may be formed for such purpose if desired.

In either of the forms of the invention the machine supporting leg (36 or 136) may be extended under the free arm to alter the appearance of the machine and provide additional support therefor. In addition, the front end of such extension may be adapted to pivotally support the front bed extension member (84 or 84').

It is to be understood, that the present disclosure relates to preferred embodiments of the invention which are for purposes of illustration only, and are not to be construed as limiting the invention. Numerous alterations and modifications will suggest themselves to those skilled in the art, and all such modifications which do not depart from the spirit and scope of the invention are intended to be included within the scope of the appended claims.

We claim:

1. A convertible bed sewing machine comprising a bracket arm extending from an upright standard to a depending head, a bed which supports the standard and includes as a part thereof a free arm which extends under the bracket arm and head, a fixed machine supporting leg extending substantially parallel to the free arm at the rear of the machine, a rear bed extending member for the free arm, a cover member fitted over the leg and having the rear bed extending member pivoted thereon for movement into and away from a position wherein a working surface on the extension is coplanar with a working surface on the free arm, the cover and rear bed extending member being removable as a unit from the machine supporting leg to provide space for an attachment, and means for securing an embroidery attachment to the free arm when the cover and rear bed extending member have been removed from the machine.

2. A convertible bed sewing machine as defined in claim 1 including a front bed extending member for the free arm pivotally movable into and away from a position wherein a working surface on the front bed extending member is coplanar with the working surface on the free arm.

3. A convertible bed sewing machine as defined in claim 2 wherein the front bed extending member is adapted to receive and store spools of thread.

4. A convertible bed sewing machine as defined in claim 2 wherein the front bed extending member is formed with wells in which spools of thread may be received and stored.

5. A convertible bed sewing machine as defined in claim 1 including a fixed rod extending substantially parallel to the free arm at the front and bottom of the machine, and a front bed extending member for the free arm pivotally mounted on said rod for movement into and away from a position wherein a working surface on the front bed extending member is coplanar with the working surface on the free arm.

6. A convertible bed sewing machine as defined in claim 1 including a wall support in engagement with the cover.

* * * * *